US006492888B2

(12) United States Patent
Dahl et al.

(10) Patent No.: US 6,492,888 B2
(45) **Date of Patent: *Dec. 10, 2002**

(54) POWER CIRCUIT BREAKER WITH AN ACTUATING SHAFT

(75) Inventors: Jörg-Uwe Dahl, Werder (DE); Ludvik Godesa, Berlin (DE); Marc Liebetruth, Glienicke (DE)

(73) Assignee: Siemens Aktiengesellschaft, Munich (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/508,021

(22) PCT Filed: Sep. 4, 1998

(86) PCT No.: PCT/DE98/02693

§ 371 (c)(1),
(2), (4) Date: Sep. 29, 2000

(87) PCT Pub. No.: WO99/12175

PCT Pub. Date: Mar. 11, 1999

(65) Prior Publication Data

US 2002/0053963 A1 May 9, 2002

(30) Foreign Application Priority Data

Sep. 4, 1997 (DE) ..... 197 39 702

(51) Int. Cl.[7] ..... H01H 9/02

(52) U.S. Cl. ..... 335/202; 335/8; 335/172

(58) Field of Search ..... 335/9–10, 16, 335/147, 195, 201, 202, 162–176; 218/9, 152, 153, 154, 155

(56) References Cited

U.S. PATENT DOCUMENTS

| | | | | |
|---|---|---|---|---|
| 3,211,876 A | | 10/1965 | Christian et al. | |
| 4,128,822 A | * | 12/1978 | Peterson, Jr. | 335/8 |
| 4,166,988 A | * | 9/1979 | Ciarcia et al. | 335/9 |
| 4,347,488 A | * | 8/1982 | Mune et al. | 335/9 |
| 4,885,558 A | * | 12/1989 | Harper | 335/8 |
| 4,891,617 A | * | 1/1990 | Beatty, Jr. et al. | 335/46 |
| 4,929,919 A | * | 5/1990 | Link et al. | 335/38 |
| 5,557,082 A | * | 9/1996 | Leet et al. | 335/9 |

FOREIGN PATENT DOCUMENTS

| | | |
|---|---|---|
| DE | 27 26 489 | 1/1978 |
| DE | 28 35 879 | 3/1979 |
| DE | 42 27 352 | 10/1993 |
| DE | 44 16 088 | 6/1995 |
| DE | 44 16 090 | 6/1995 |
| FR | 1 410 836 | 12/1965 |

* cited by examiner

*Primary Examiner*—Lincoln Donovan
(74) *Attorney, Agent, or Firm*—Kenyon & Kenyon

(57) ABSTRACT

A low-voltage circuit breaker has a contact arrangement, a drive mechanism for actuating the contact arrangement , and an actuating shaft, which is used for transmitting a drive force from the drive mechanism to the contact arrangement. A bearing device for the actuating shaft has at least one bearing body, which is connected to a pole component accommodating the contact arrangement. Thus a unit is formed, which can be tested independently of the other components of the circuit breaker. In the case of multipole circuit breakers, a common actuating shaft is used for all contact arrangements and pole components, which is mounted approximately in the center of the main bearing body and near the ends of the auxiliary bearing bodies.

10 Claims, 3 Drawing Sheets

POWER CIRCUIT BREAKER WITH AN ACTUATING SHAFT

RELATED APPLICATIONS

This application is a 371 of PCT/DE98/02693 filed Sep. 04, 1998.

FIELD OF THE INVENTION

The present invention relates to a low voltage circuit breaker having a contact arrangement, a drive mechanism for actuating the contact arrangement, an actuating shaft for transmitting a drive force from the drive mechanism to the contact arrangement, and a bearing arrangement accommodating the actuating shaft.

BACKGROUND INFORMATION

Low voltage circuit breakers have a plurality of components that are adapted to different partial functions and are connected to one another during the manufacture of the circuit breaker. The largest components or units are the switching poles, i.e., contact systems that include stationary and movable switching contacts, with their support insulation and components for connecting to a drive mechanism common to a plurality of such switching poles. The movement provided by the drive mechanism is transmitted to all existing contact systems via an actuating shaft supported at a fixed point. Formerly the actuating shaft was considered as a component of the drive mechanism from the design point of view.

An example of this design is described in German Patent No. 44 16 088, which shows a lever arrangement having a conventional design for transmitting a drive force. It has parallel support plates and limiting parts attached thereto, which reduce the distance between the support plates to an appropriate value for guiding the articulated levers. The hinge pins of the levers are slidingly guided on the limiting parts.

German Patent Patent 44 16 090 shows a bearing arrangement for an actuating shaft of a multipole electrical switchgear having a bearing mechanism formed by parallel walls and having shaft bearings with half-shells. In German Patent No. 42 27 352 there is illustrated an actuating shaft common to the pole units formed from the switching chambers, which is formed from shaft segments corresponding to the pole units. The pole units rest on a support, which is dimensioned according to the largest width of the pole units. Further illustrations of force transmission systems for actuating switching contacts are described in German Patent No. 28 35 879 and German Patent No. 27 26 489. All these described designs have proven to facilitate the manufacture of the individual components, but they have the disadvantage that their function cannot be tested until the circuit breaker is fully assembled.

This means that, from the mechanical point of view, if a defect is found in a fully assembled circuit breaker, it is difficult to determine which component is defective. Ultimately the fully assembled components must be disassembled in order to replace the defective component.

SUMMARY

An object of the present invention is to facilitate testing and reduce the time needed for troubleshooting. In particular, a test of whether the path provided by the drive yields the contact force needed for regular closing of the contact arrangements is to be performed.

This object is achieved according to the present invention by the fact that the bearing arrangement for the actuating shaft has at least one bearing body connected to a pole component accommodating the contact arrangement.

The "switching pole" component thus becomes fully operational by itself and can be tested in a simple manner before the circuit breaker is fully assembled. Furthermore, there are no disadvantages to the standalone testability of the drive mechanism.

According to one example embodiment of the present invention, the actuating shaft is integrated in the "switching pole" component by using at least three bearing bodies, the central main bearing body having conventional elements, in particular springs for providing a retaining force, end stops, a chatter limiter and elements for absorbing residual energy. This central main bearing body is advantageously connected to one wall of the pole component via a combination of positive and non-positive attachment elements. These may advantageously be two or more plug-in bases in conjunction with the respective pocket holes in the wall of the pole component, and centering journals with internal threads that align the central main bearing body with respect to the pole component wall and the drive mechanism. Near its ends, the actuating shaft is supported by two auxiliary bearing bodies, which are fastened in the same manner or in similar manners, but which have only part or none of the above-mentioned additional functions. The manufacture and assembly of the actuating shaft can be facilitated by dividing the actuating shaft into two symmetric segments. These segments are driven synchronously via a coupling pin traversing the lever mounted on both segments of the actuating shaft. The advantage of the two-part actuating shaft is that each of the segments is supported at two bearing points. The type of support is thus statically determined and can therefore be implemented with little play. Any possible alignment error is compensated via the coupling without affecting the friction characteristics.

The main bearing body with an abutment for retaining springs, which maybe molded onto the main bearing body to form a single piece. The retaining springs can be mounted on the main bearing body prior to the assembly of the bearing arrangement. The retaining springs are thus arranged in a compact manner and advantageously engage the actuating shaft lever as a dead center or super-dead center system. This reduces the reaction on the main energy storage device of the switching drive.

DETAILED DESCRIPTION

Figure 1:
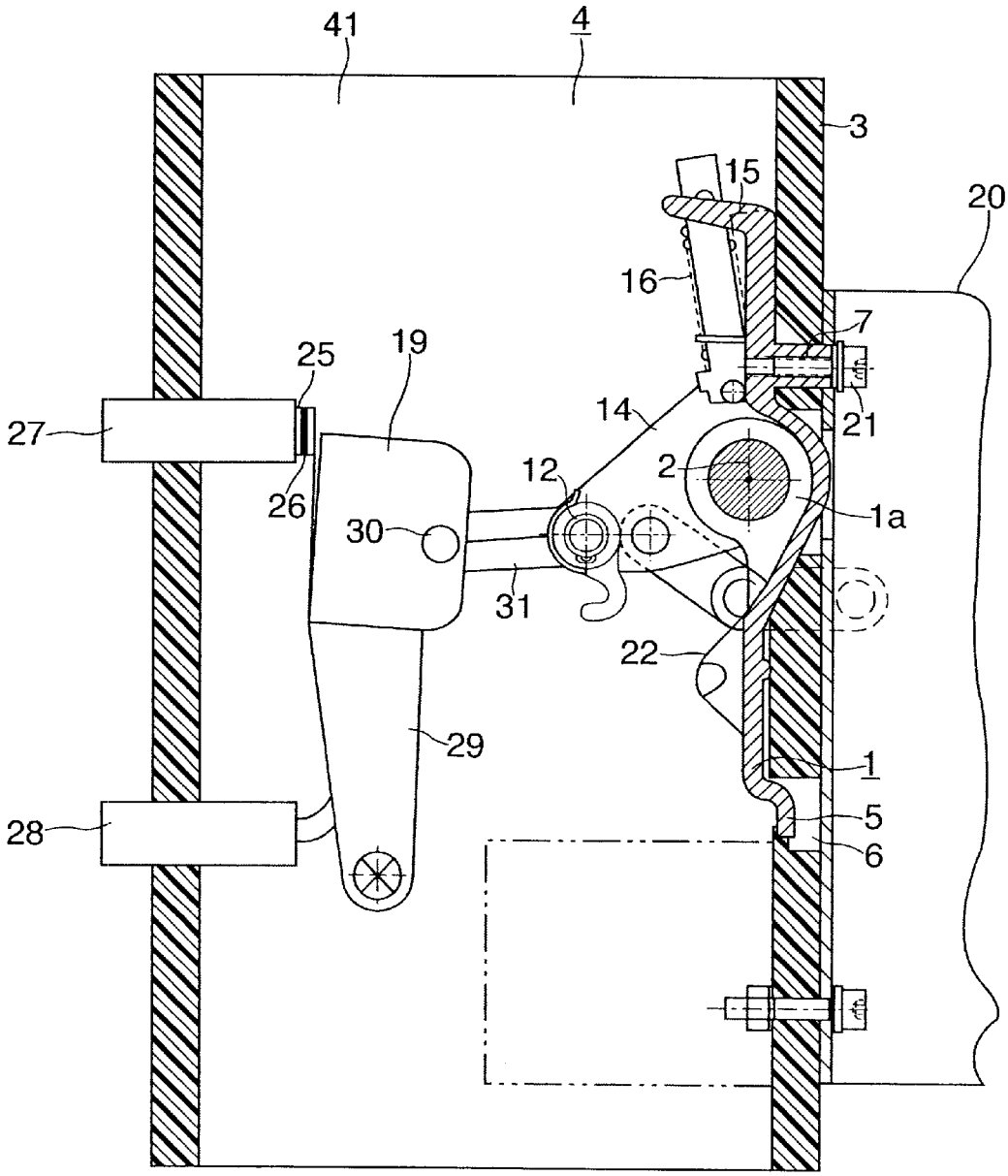
FIG. 1 schematically shows the lateral view of the arrangement of the actuating shaft in the "switching pole" component with the contact arrangement closed.
Figure 2:
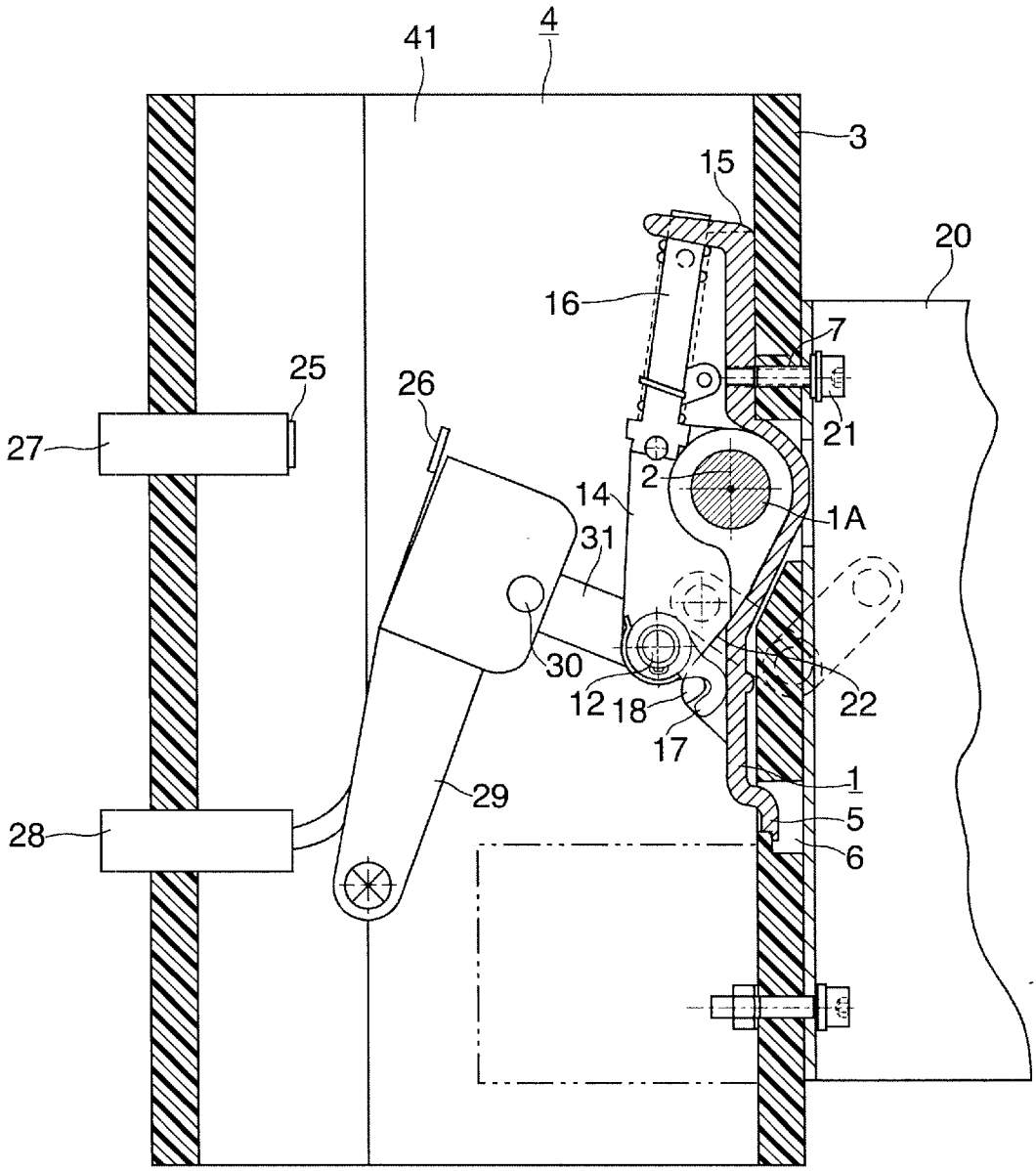
FIG. 2 schematically shows the arrangement according to FIG. 1 with the contact arrangement open.
Figure 3:
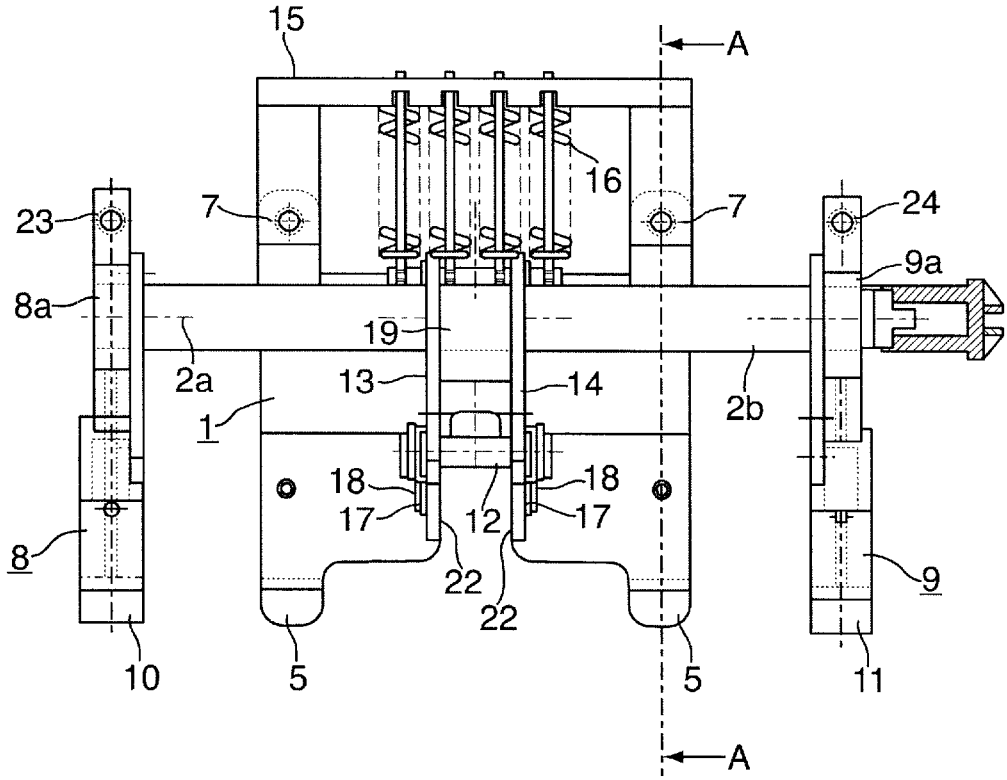
FIG. 3 schematically shows a front view of the arrangement according to FIG. 1.

FIGS. 1 and 2 show a single-pole pole component 4 for a low-voltage circuit breaker. The pole component 4 includes a switching pole and housing 41, the housing 41 accommodating the switching pole. As is conventional, the switching pole includes a stationary switching contact 25, which is connected to an upper connecting bar 27, and a movable contact arrangement 19. The movable arrangement includes a rotatable fulcrum bracket (support insulator 29) and a movable switching contact 26, which is supported on fulcrum bracket 29 and is connected to a lower connecting bar 28. Connecting bars 27 and 28 project from the outside into housing 41 of pole component 4. In addition to further components, fulcrum bracket 29 is used for coupling moveable switching contact 26 to an actuating shaft 2. Among these additional components are a coupling lever 31, two levers 13 and 14 securely mounted on actuating shaft 2, and two coupling pins 30 and 12. A bearing body 20 for accommodating a drive mechanism, which is coupled to actuating shaft 2, is attached from the outside to housing 41 of pole component 4. In this context, actuating shaft 2 is supported in a stationary manner via a bearing arrangement 1, 8 and 9, which is attached to the inside wall 3 of housing 41. The arrangement of central or middle main bearing body 1 is shown in sectional view FIGS. 1 and 2, and the arrangement of the auxiliary bearing bodies is represented in FIG. 3 in relation to the main bearing body. Central main bearing body 1 has a bearing section 1*a*, which is provided with a cylindrical hole and is used for supporting actuating shaft 2, and is connected to a wall 3 of housing 41 of pole component 4 by two plug-in bases 5 in conjunction with corresponding pockets 6 in wall 3 of pole component 4 and to centering journals 7 having an internal thread, which align main bearing body 1 with respect to wall 3 of pole component 4 and with respect to bearing body 20, which is indicated in FIG. 1. In this context, each of the plug-in bases 5 abuts against an inner surface of an allocated pocket 6 in wall 3 of pole component 4. Thus, when assembled, plug-in bases 5 and pocket 6 form a positive connection between main bearing body 1 and pole component 4. Via two fixing bolts 21, which, from the side facing away from the main bearing body, each penetrate a supporting wall of the drive mechanism and wall 3 of pole component 4 and are each screwed into a centering journal 7, the main bearing body is connected in a non-positive manner to the pole component in the case of simultaneous alignment with respect to the pole component and the drive mechanism. As FIG. 3 shows, actuating shaft 2 is supported near its ends by two auxiliary bearing bodies 8 and 9. Both of the two auxiliary bearing bodies 8 also have a bearing section 8*a* and 9*a*, respectively, which is provided with a cylindrical hole and is used to support actuating shaft 2, and are secured via plug-in bases 10 and 11, as well as by a centering journal 7 to wall 3 of pole component 4. The above-described arrangement of an actuating shaft 2 is well suited, in particular, for multipole circuit breakers, where pole components 4, as FIGS. 1 and 2 show, are arranged next to one another and are actuated jointly by actuating shaft 2. Instead of single-pole components, a contiguous three-, four-, or multipole pole component can also be provided. The advantages of the present invention are that the joint operation of the drive, actuating shaft and circuit breaker pole can be tested prior to the final assembly of the circuit breaker. If a defect is found, the components of the final assembly do not need to be dismantled in order to replace the defective components. Thus the time required for troubleshooting is considerably reduced. This is particularly advantageous in the case of multipole circuit breakers.

What is claimed is:

1. A pole component for a low-voltage circuit breaker, comprising:

a housing;

at least two connecting bars projecting into the housing;

an actuating shaft;

at least one switching pole, the housing accommodating the at least one switching pole, the at least one switching pole including stationary switching contact, a movable switching contact and components coupling the movable switching contact to the actuating shaft, the stationary switching contact and the movable switching contact each connected to one of the connecting bars;

a bearing body configured to accommodate a drive mechanism to be coupled to the actuating shaft, the bearing body attached to an outside of a wall of the housing; and a bearing arrangement attached to an inside of the wall of the housing, the bearing arrangement supporting the actuating shaft in a stationary manner.

2. The low-voltage circuit breaker according to claim 1 wherein:

the actuating shaft includes two segments having a respective coupling side, each of the two segments being provided with a radially projecting lever at the respective coupling side; and the bearing arrangement includes at least three bearing bodies connected in a positive and non-positive manner to the wall of the housing, the at least three bearing bodies including:

a main bearing body having a cylindrical hole which accommodates a respective first end at the respective coupling side of each of the two actuating-shaft segments; and two auxiliary bearing bodies, each of which accommodates a respective second end of one of the two actuating-shaft segments, which respective second ends of the two actuating-shaft segments face away from one another.

3. The low-voltage circuit breaker according to claim 2, wherein the main bearing body includes at least two plug-in bases for connection in a positive manner to corresponding pockets in the wall of the housing and two centering journals for aligning the main bearing body in the wall of the housing and for connecting the main bearing body to the wall of the housing in a non-positive manner.

4. The low-voltage circuit breaker according to claim 2, wherein each of the auxiliary bearing bodies includes at least one plug-in base for connection in a positive manner to corresponding pockets in the wall of the housing and centering journals for aligning the auxiliary bearing bodies in the wall of the housing and for connecting the auxiliary bearing bodies to the wall of the housing in a non-positive manner.

5. The low-voltage circuit breaker according to claim 3, wherein the centering journals are provided with an internal thread for accommodating a fixing bolt.

6. The low-voltage circuit breaker according to claim 2, wherein the main bearing body includes:

two stop faces, each assigned to one of the levers, for forming and end stop; and two catch elements, which can be gripped from behind by a hook, for forming a chatter limiter and retaining springs.

7. The low-voltage circuit breaker according to claim 2, wherein the main bearing body has an abutment for retaining springs acting in a manner of a dead center or superdead center.

8. The low-voltage circuit breaker according to claim 7, wherein the abutment is molded on the main bearing body to form a single piece with the main bearing body.

9. The low-voltage circuit breaker according to claim 2, wherein the segments of the actuating shaft have a symmetric design.

10. The low-voltage circuit breaker according to claim 2, further comprising:

a coupling pin traversing the levers for connecting the segments of the shaft.

* * * * *